US007380745B2

(12) United States Patent
Narita et al.

(10) Patent No.: US 7,380,745 B2
(45) Date of Patent: Jun. 3, 2008

(54) WINDING DEVICE OF SLITTER

(75) Inventors: Keizo Narita, Kyoto (JP); Hiroshi Kimura, Kyoto (JP); Minoru Kato, Kyoto (JP)

(73) Assignee: Nishimura Seisakusho Co., Kyoto (JP)

( * ) Notice: Subject to any disclaimer, the term of this patent is extended or adjusted under 35 U.S.C. 154(b) by 0 days.

(21) Appl. No.: 10/514,354

(22) PCT Filed: Apr. 21, 2003

(86) PCT No.: PCT/JP03/05068

§ 371 (c)(1),
(2), (4) Date: Nov. 12, 2004

(87) PCT Pub. No.: WO03/095347

PCT Pub. Date: Nov. 20, 2003

(65) Prior Publication Data

US 2005/0156077 A1 Jul. 21, 2005

(30) Foreign Application Priority Data

May 14, 2002 (JP) ..... 2002-138806

(51) Int. Cl.
*B65H 18/08* (2006.01)

(52) U.S. Cl. ..... 242/530.1; 242/533.7

(58) Field of Classification Search ..... 242/530.1, 242/530, 530.4, 533, 533.2, 533.7, 598.1, 242/598.2, 525, 540, 533.8
See application file for complete search history.

(56) References Cited

U.S. PATENT DOCUMENTS 2,038,660 A * 4/1936 Kretzschmar ..... 254/2 C
3,534,779 A * 10/1970 Matouch et al. ..... 139/101
3,845,915 A * 11/1974 Schmidt et al. ..... 242/533
4,030,681 A 6/1977 Schott
5,429,320 A 7/1995 Pack
5,941,474 A * 8/1999 Cushing ..... 242/533.1
6,199,789 B1 * 3/2001 Marco ..... 242/533.7

FOREIGN PATENT DOCUMENTS

JP 02209353 A * 8/1990
JP 4-323151 A 11/1992
JP 5-147780 A 6/1993
JP 11-71048 A 3/1999

OTHER PUBLICATIONS

Translation of previously cited reference JP04323151.*

* cited by examiner

*Primary Examiner*—Peter M. Cuomo
*Assistant Examiner*—William E Dondero
(74) *Attorney, Agent, or Firm*—Hodgson Russ LLP

(57) ABSTRACT

A winding device of a slitter capable of winding web material on a winding shaft supportedly disposed between a pair of side plates after the web material is slit, the winding shaft including two divided shafts positioned substantially end to end, the divided portions thereof are supported on an intermediate support member, the web material is wound on the winding shaft in that state, and after the web material is wound, the divided portions are moved in a direction apart from each other in the axial direction of the winding shaft to extract the winding shaft from a wound product, whereby, even if the width of the web material is large, the web material can be accurately wound, and after winding, the wound product and the winding shaft can be easily separated from each other.

2 Claims, 7 Drawing Sheets

14
19
7
6
10
23
24
23a
23a
24
23
10
23
6

WINDING DEVICE OF SLITTER

TECHNICAL FIELD

The invention relates to an apparatus for winding slit webs about a winding shaft after slitting the web in a slitter. The web comprises a plastic film or the like.

BACK GROUND

It is often in the slitter that the winding shaft is disposed between and supported by a pair of side plates. The winding shaft is rotated by a drive motor to wind slit webs about the winding shaft after slitting the web. The web comprises a plastic film or the like.

It has recently been required to slit a web which is wide, and then wind the webs in the slitter. However, in case of the web which is wide, the winding shaft must be long to wind the webs about the winding shaft. The winding shaft may therefore be weighed down between the side plates due to the length of the winding shaft, making it difficult to wind the webs reliably. In addition, the winding shaft must be heavy in weight in proportion to the length thereof. It is therefore difficult to make the winding shaft moved axially thereof and extracted and separated from winding products after winding. The winding shaft must be moved for a long stroke corresponding to the width of the web, to be extracted from the winding products, taking labor and time.

It is therefore an object of the invention to provide an apparatus for winding slit webs about a winding shaft after slitting the web in a slitter, the winding shaft being disposed between and supported by a pair of side plates, which can wind the webs reliably and then make the winding products and the winding shaft separated from each other without difficulty, even if the web is wide.

DISCLOSURE OF THE INVENTION

According to the invention, the winding shaft comprising two divided shafts positioned substantially end to end which are supported by an intermediate support member positioned between the divided shafts, to wind the webs about the divided shafts. The divided shafts are moved axially thereof and apart from each other to be extracted from winding products after winding.

In a preferred embodiment, each of the side plates is provided with a drive motor connected to the divided shaft. The divided shaft includes an end provided with a bearing box and disposed at the position of intermediate support member, the bearing box being supported by the intermediate support member. The divided shaft is rotated by the drive motor to wind the webs. Each of the side plates is moved axially of the winding shaft after winding. The divided shaft is drawn by the side plate so that the bearing box can be drawn from the intermediate support member. The divided shaft is then extracted from the winding products.

Each of the divided shafts may be supported by the side plate for turning movement about a vertical axis. The divided shaft is turned about the vertical axis after winding the webs. Winding products are then extracted from the divided shaft.

The divided shaft may include an end provided with a bearing box and disposed at the position of intermediate support member, the bearing box being supported by the intermediate support member. The divided shaft is turned about the vertical axis after winding so that the bearing box can be drawn from the intermediate support member.

BEST MODE TO CARRY OUT THE INVENTION

Figure 1:
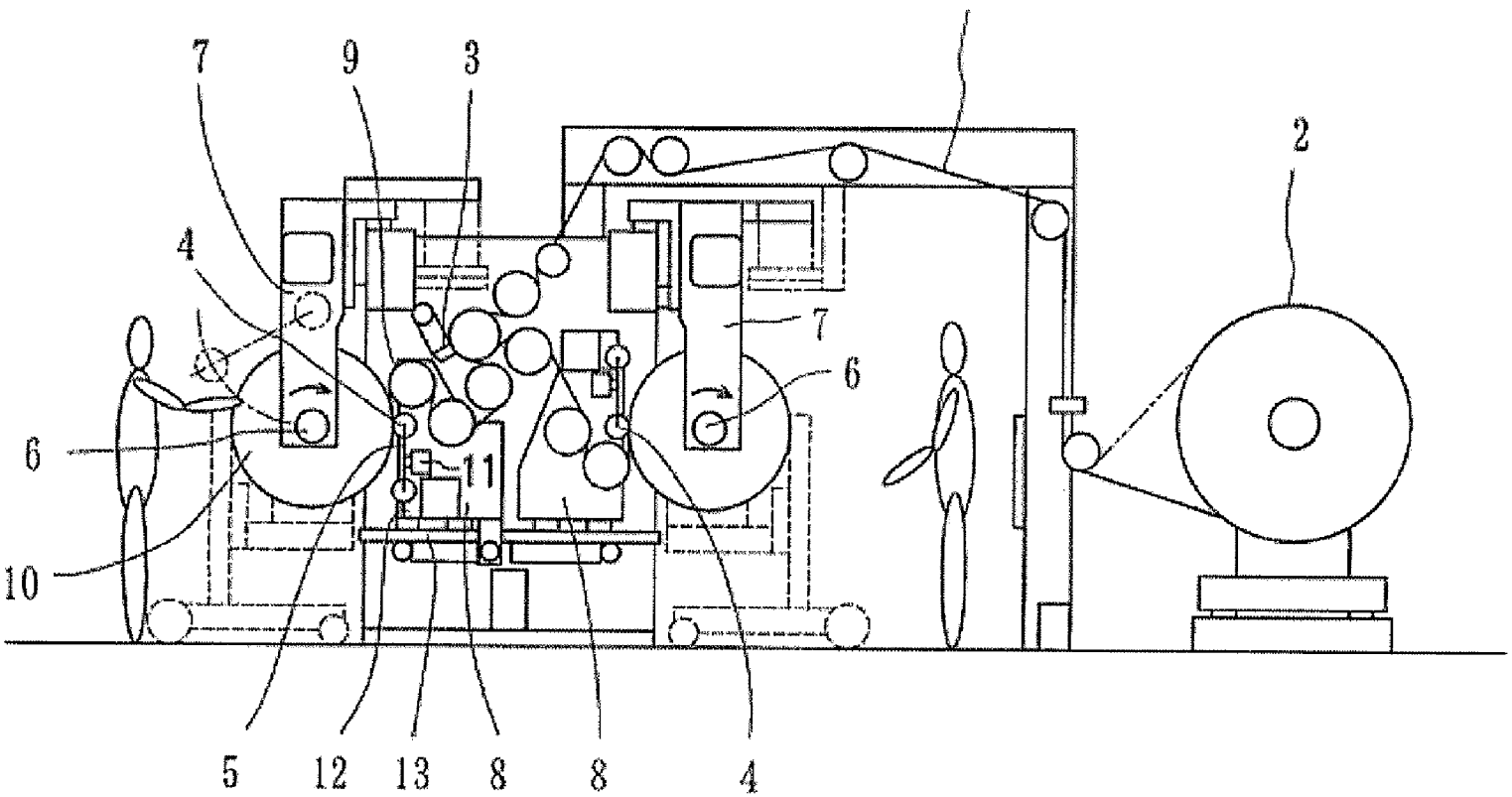
FIG. 1 is an explanatory view of a preferred embodiment of the invention.

Referring now to the drawings, FIG. 1 illustrates a slitter according to the invention, in which a web 1 is supplied from a supply roll 2 and directed to a slitting blades 3 to be slit into a plurality of slit webs, as in the case of the prior art. A pair of winding apparatus is disposed in front and in the rear of the slitter, the webs 1 being directed to each of the apparatus after slitting the web, as also in the case of the prior art.

Figure 2:
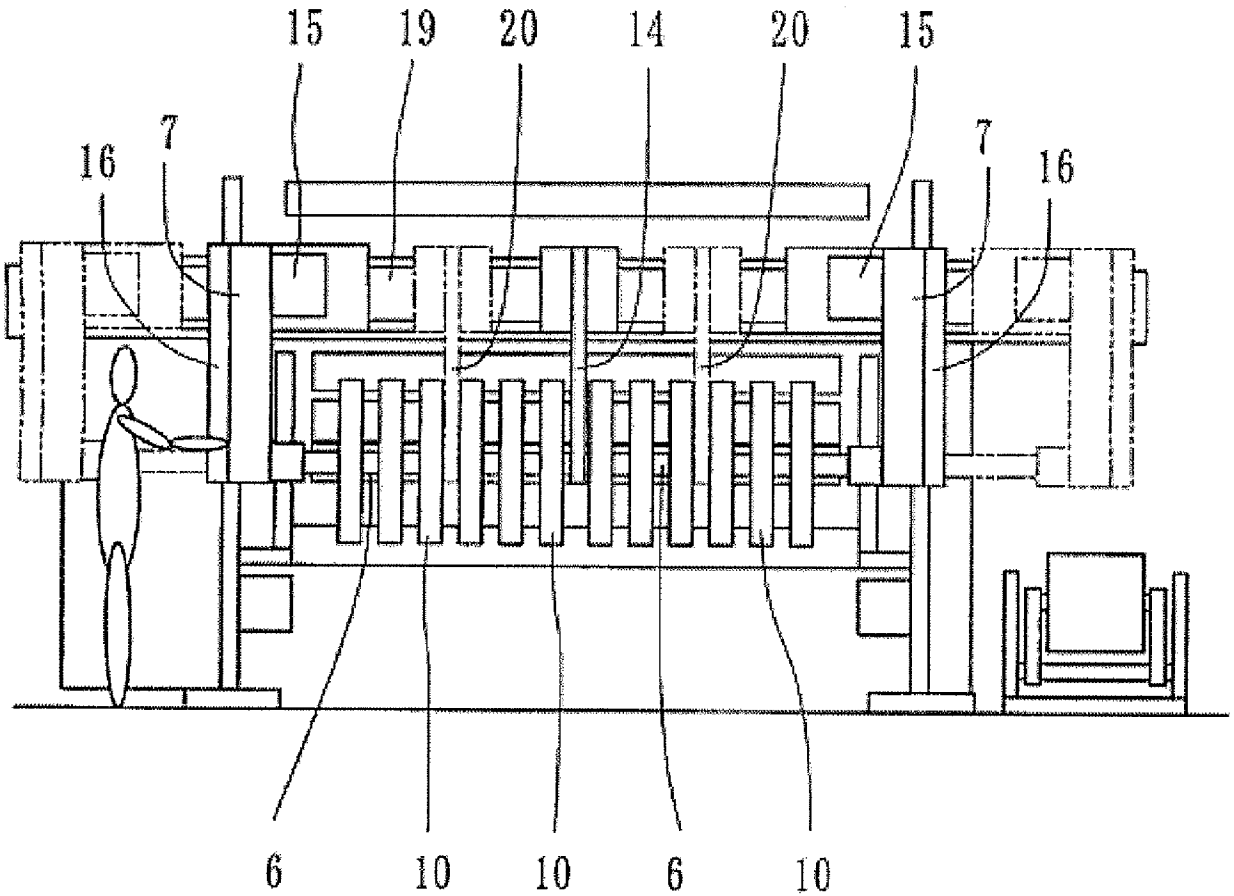
FIG. 2 is an elevational view of the apparatus of FIG. 1.

Each of the apparatus includes a contact roller 4 supported by arms 5. The apparatus further includes a winding shaft 6 disposed between and supported by a pair of side plates 7, as shown in FIG. 2. A carriage 8 includes a guide roller 9 through which the webs 1 are directed to the contact roller 4 and the winding shaft 6 to wind the webs 1 about the winding shaft 6 and into winding rolls 10. The contact roller 4 is brought into contact with the winding rolls 10. Cylinders 11 exert action on the arms 5 and the contact roller 4 to generate a contact pressure between the contact roller 4 and the winding rolls 10. The carriage 8 includes a slide 12 by which the arms 5 and the cylinders 11 are supported, the carriage 8 being moved along rails 13 so that the contact roller 4, the arms 5 and the cylinders 11 can be moved apart from the winding shaft 6 in accordance with the increase in diameter of the winding roll 10, as disclosed in Japanese Patent No. 2,958,570.

Figure 3:
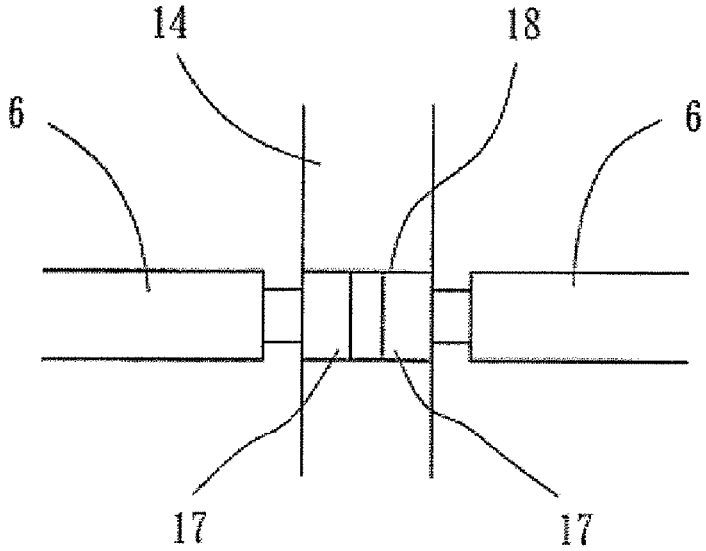
FIG. 3 is a sectional view illustrating the relative arrangement between the divided shafts and the intermediate support member of FIG. 2.
Figure 4:
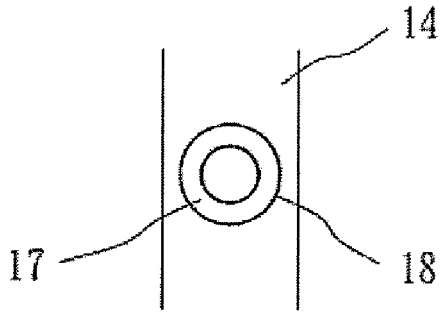
FIG. 4 is a side view of the intermediate support member of FIG. 3.

In the apparatus, the winding shaft 6 comprising divided shafts positioned substantially end to end which are supported by an intermediate support member 14 positioned between the divided shafts 6, to wind the webs 1 about the divided shafts 6. In the embodiment, each of the side plates 7 is provided with a drive motor 15. The drive motor 15 is connected to the divided shaft 6 through a belt or chain 16. The divided shaft 6 includes an end provided with a bearing box 17 and disposed at the position of intermediate support member 14, as shown in FIG. 3 and FIG. 4. The intermediate support member 14 includes a bore 18 having a size corresponding to the bearing box 17. The bearing box 17 is fitted into the bore 18 to be supported by the intermediate support member 14. Each of the divided shafts 6 is therefore supported by the side plate 7 and the intermediate support member 14. The divided shaft 6 is rotated by the drive motor 15 to wind the webs 1 thereabout. The intermediate support member 14 may include locking means for locking the bearing box 17 in the bore 18.

Figure 5:
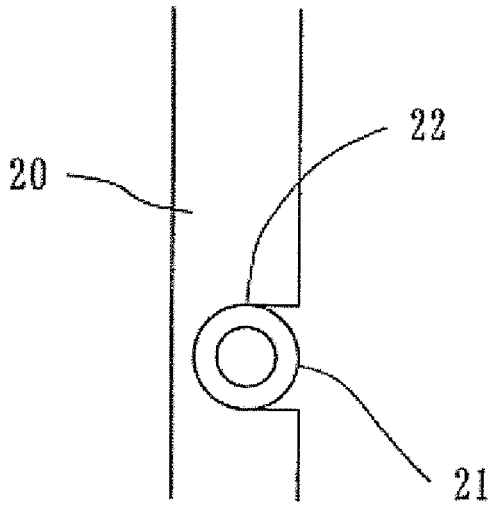
FIG. 5 is a side view illustrating the relative arrangement between the divided shafts and the auxiliary support members of FIG. 2.

The side plates 7 are a type of suspension suspended from and supported by a rail 19 for movement along the rail 19. The rail 19 extends axially of the winding shaft 6. The intermediate support member 14 is also suspended from and supported by the rail 19. In addition, auxiliary support members 20 are disposed between the side plates 7 and the intermediate support member 14 and suspended from and supported by the rail 19. Each of the divided shafts 6 includes a bearing box 21 disposed in position, as shown in FIG. 5. Each of the auxiliary support members 20 includes a recess 22 formed therein, opening laterally and fitted with the bearing box 21 so that the divided shaft 6 can be supported by the auxiliary support member 20. The auxiliary support member 20 may include locking means for locking the bearing box 21 in the recess 22.

Figure 6:
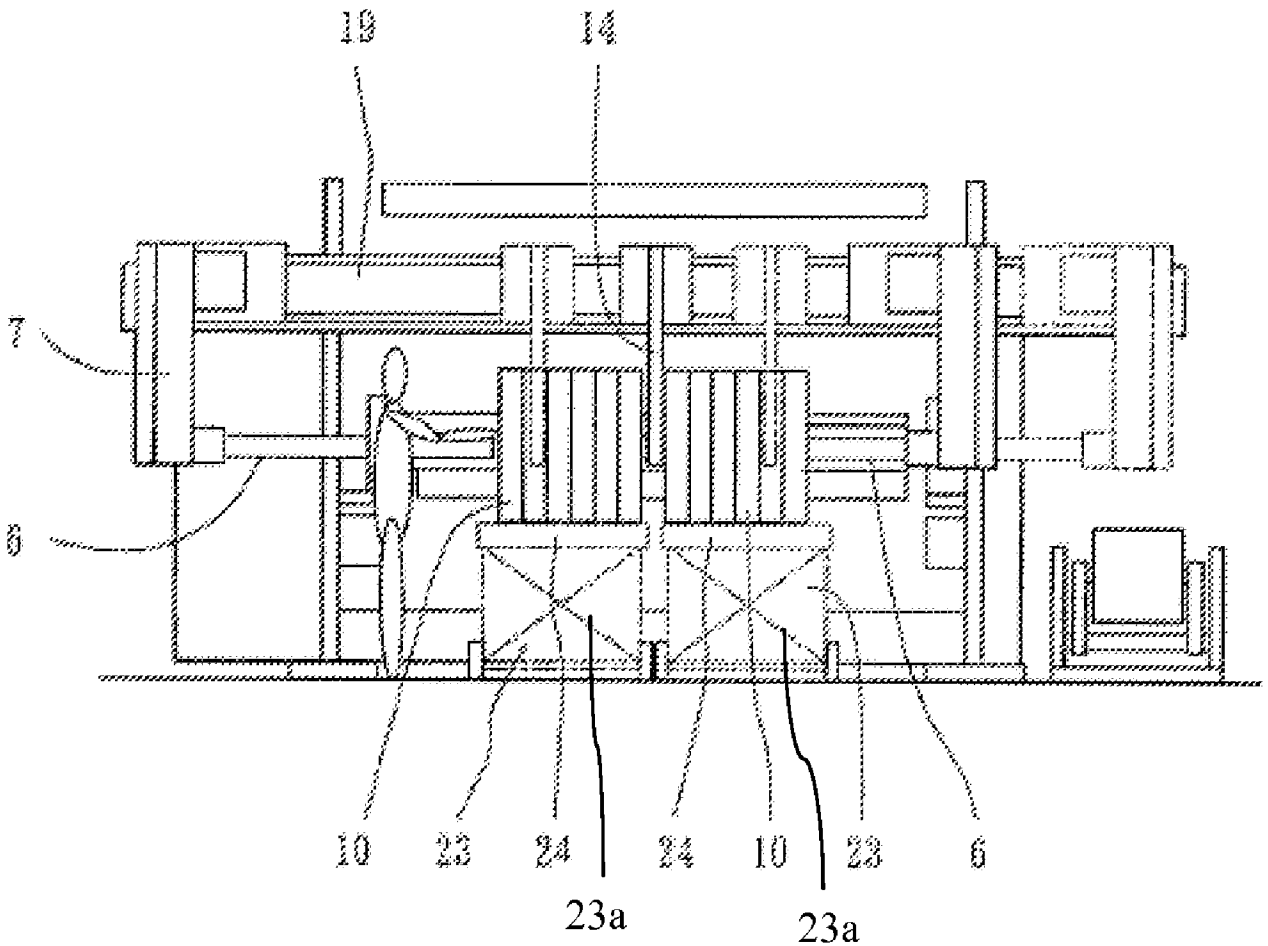
FIG. 6 is an explanatory view illustrating the divided shafts when being extracted from the winding products of FIG. 2.

The divided shafts 6 are moved axially thereof and apart from each other to be extracted from winding products 10 after winding the webs 1. In the embodiment, operators make the auxiliary support members 20 turned about the rail 19 after winding, to be retracted from the divided shafts 6 and the winding products 10. Operators then make the winding products 10 moved widthwise thereof along the divided shafts 6 and toward the intermediate support member 14, as shown in FIG. 6. Furthermore, carts 23 are disposed under the winding products 10. The carts 23 include lifters 23*a* by which tables 24 are lifted so that the winding products 10 can be supported on the tables 24. Operators then make each of the side plates 7 moved axially of the winding shaft 6 and along the rail 19. The divided shaft 6 is therefore drawn by the side plate 7 so that the bearing box 17 can be drawn from the intermediate support member 14. The divided shaft 6 is further drawn by the side plate 7 to be extracted and separated from the winding products 10. The winding products 10 are then fed by the carts 23.

Accordingly, the apparatus has no problem even if the web 1 is wide. The winding shaft 6 is long to wind the webs 1 about the winding shaft 6. In this connection, it should be recognized that the winding shaft 6 is divided axially thereof and into two divided shafts, as described above. The winding shaft 6 is supported by the intermediate support member 14, as also described above. The winding shaft 6 is therefore kept from being weighed down between the side plates 7 regardless of the length of the winding shaft 6, to wind the webs reliably. In addition, the divided shafts 6 are supported by the auxiliary support members 20 to be kept from being weighed down between the side plates 7. Furthermore, it is merely required to make not all the winding shaft but each of the divided shafts 6 moved axially thereof and extracted from the winding products 10 after winding the webs 1. In this connection, it should be recognized that the divided shaft 6 is light in weight which is half as much as the winding shaft. In addition, it is merely required to make the divided shaft 6 moved for a short stroke. The apparatus can therefore make the winding products 10 and the winding shaft 6 separated from each other without difficulty.

Figure 7:
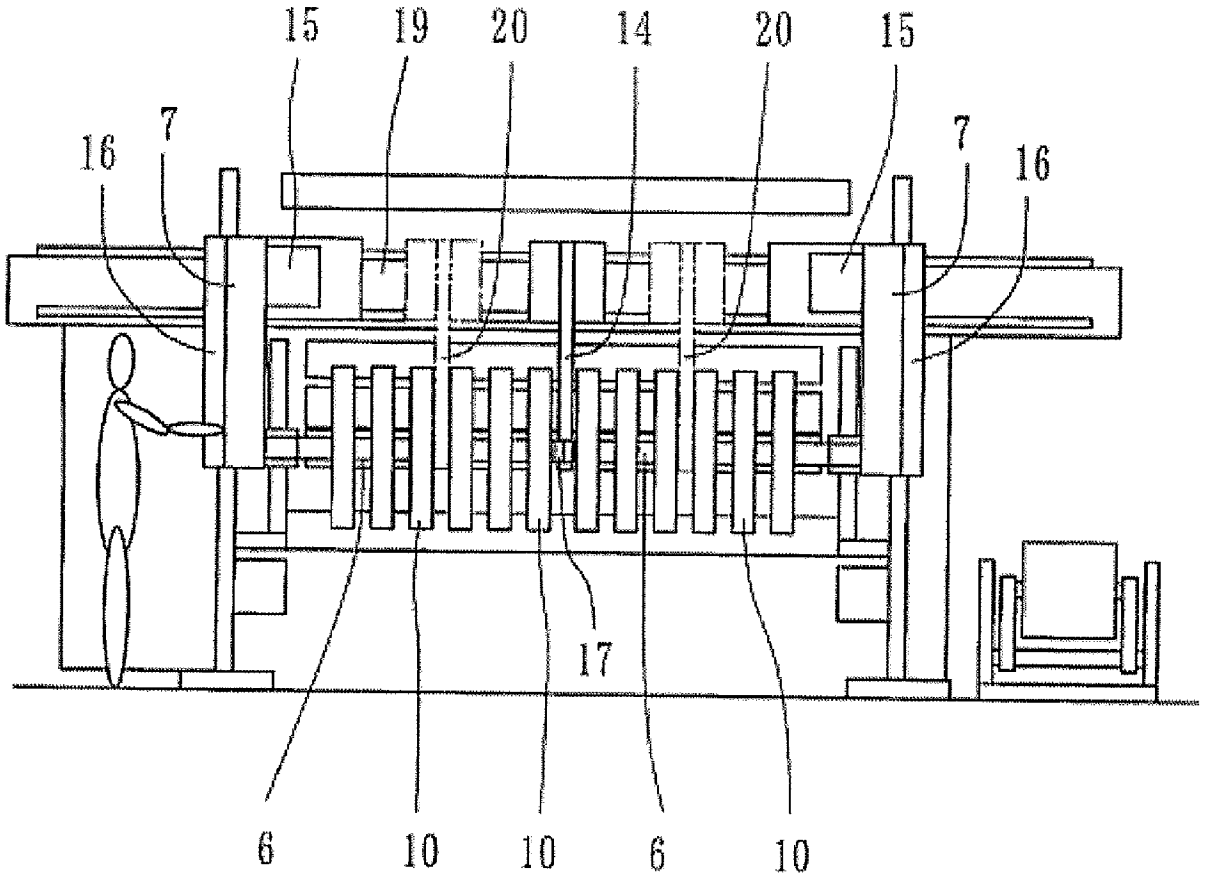
FIG. 7 is an elevational view of other embodiment.
Figure 8:
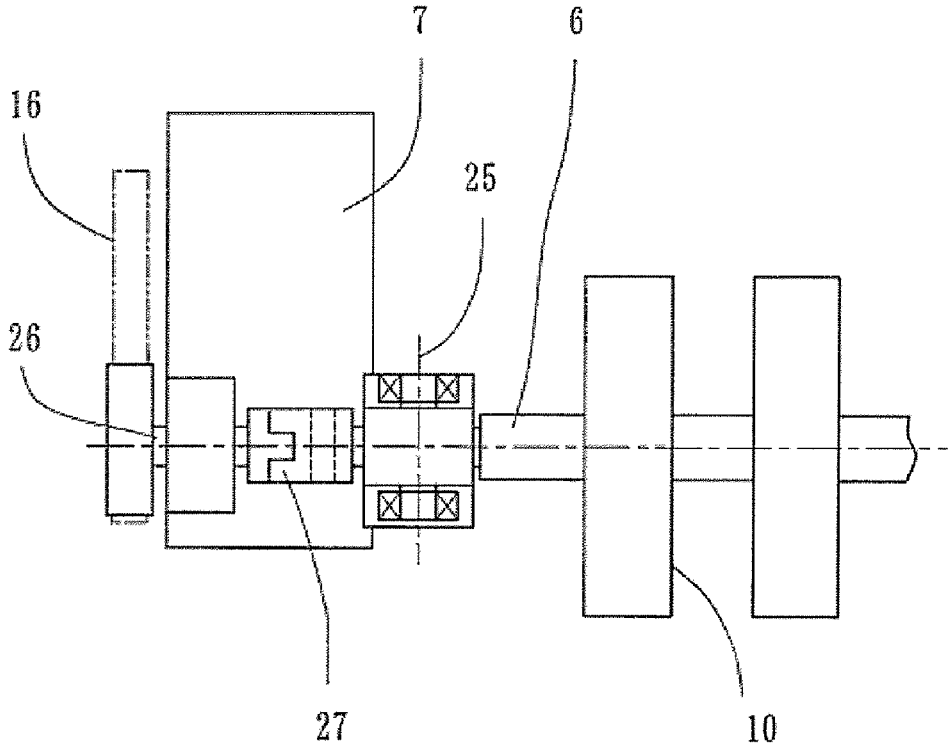
FIG. 8 is an enlarged view of the apparatus of FIG. 7.

FIG. 7 illustrates other embodiment. In the embodiment, the winding shaft 6 is disposed between and supported by a pair of side plates 7, as in the case of the apparatus of FIG. 1. The winding shaft 6 is divided axially thereof and into two divided shafts which are supported by an intermediate support member 14 positioned between the side plates 7, to wind the webs 1 about the divided shafts 6. Furthermore, in the embodiment, each of the divided shafts 6 is supported by the side plate 7 for turning movement about a vertical axis 25, as shown in FIG. 8. The divided shaft 6 is turned about the vertical axis 25 after winding the webs 1. The winding products 10 are then extracted from the divided shaft 6.

Figure 9:
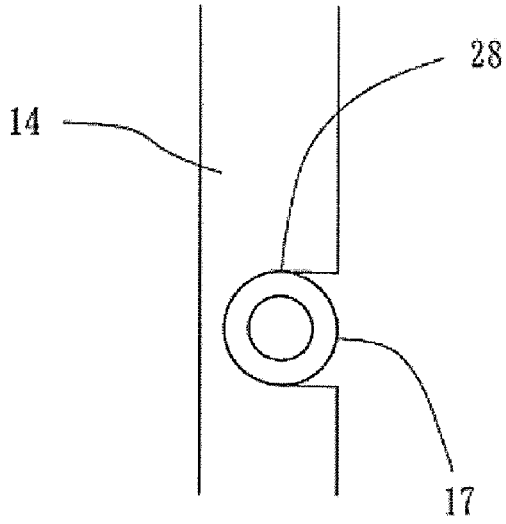
FIG. 9 is a side view illustrating the relative arrangement between the divided shafts and the intermediate support member of FIG. 7.

Furthermore, in the embodiment of FIG. 7, each of the side plates 7 is provided with a drive motor 15. The drive motor 15 is connected to the divided shaft 6 through a belt or chain 16, a transmission shaft 26 and a coupling 27 which is disposed near the vertical axis 25. The coupling 27 comprises a Oldham's shaft coupling. The divided shaft 6 includes an end provided with a bearing box 17 and disposed at the position of intermediate support member 14, as shown in FIG. 9. The intermediate support member 14 includes a recess 28 formed therein and opening laterally. The bearing box 17 is fitted into the recess 28 and supported by the intermediate support member 14. Each of the divided shafts 6 is therefore supported by the side plate 7 and the intermediate support member 14. The divided shaft 6 is rotated by the drive motor 15 and the coupling 27 to wind the webs 1 thereabout. The intermediate support member 14 may include locking means for locking the bearing box 17 in the recess 28.

In the embodiment of FIG. 7, a contact roller 4 is brought into contact with winding rolls 10 to generate a contact pressure therebetween, when winding the webs 1 about the winding shaft 6, as in the case of the apparatus of FIG. 1. A carriage 8 is moved along rails 13 so that the contact roller 4 can be moved apart from the winding shaft 6 in accordance with the increase in diameter of the winding roll 10, as also in the case of the apparatus of FIG. 1.

Figure 10:
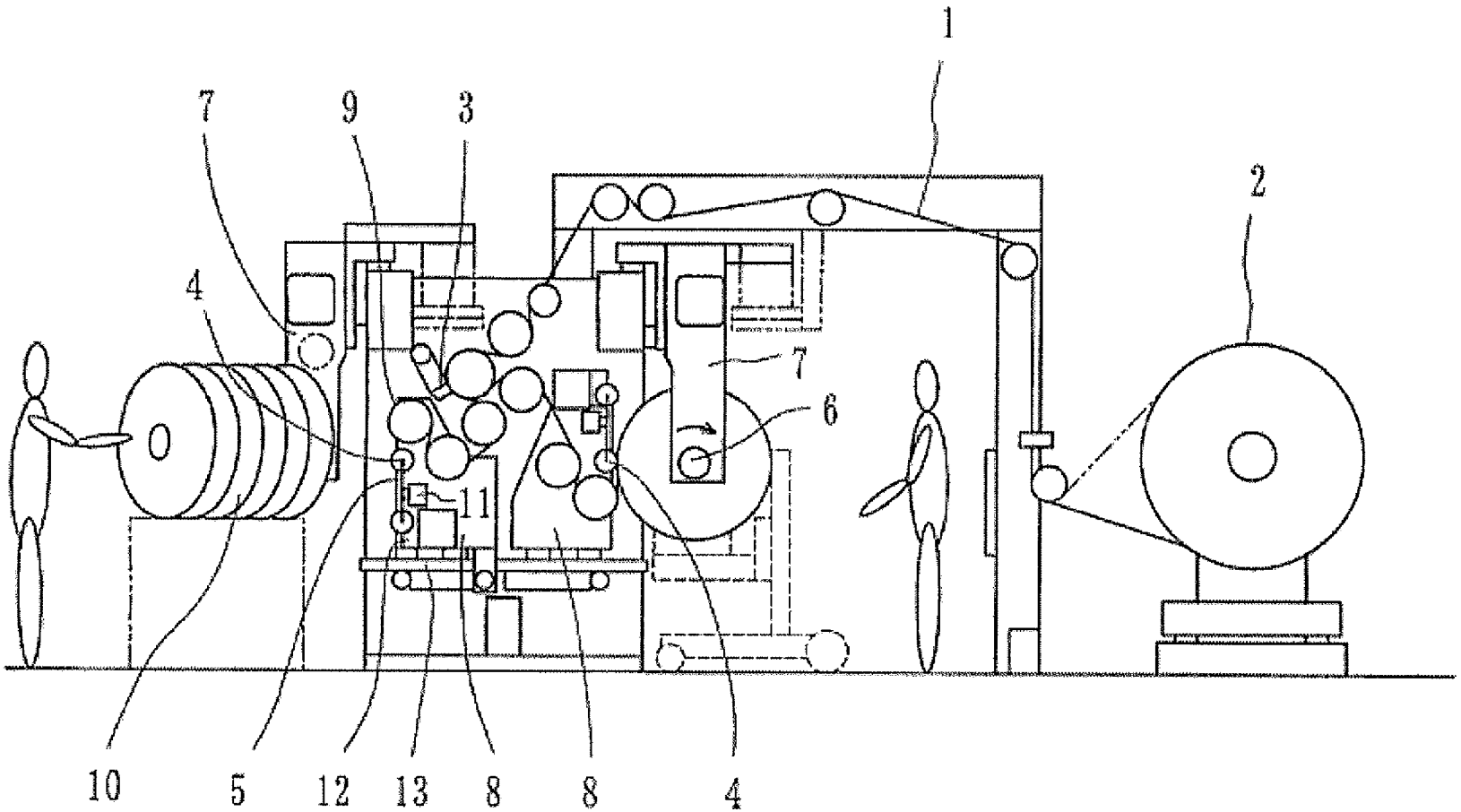
FIG. 10 is an explanatory view illustrating the winding products when being extracted from the divided shafts.

Operators make the divided shafts 6 turned about the vertical axis 25 after winding the webs 1 so that the bearing boxes 17 can be drawn from the intermediate support member 14. The divided shafts 6 and the winding products 10 protrude in front and the rear of the slitter when the divided shafts 6 have been turned in each of the apparatus, as shown in FIG. 10. The winding products 10 are then extracted from the divided shafts 6 in front and the rear of the slitter.

Accordingly, the winding shaft 6 is supported by the intermediate support member 14 to be kept from being weighed down between the side plates 7 even if the web 1 is wide, to wind the webs reliably. The winding products 10 are extracted from the divided shafts 6 in front and the rear of the slitter after winding the webs 1, to make the winding products 10 and the winding shaft 6 separated from each other without difficulty.

According to the invention, the winding shaft can be kept from being weighed down between the side plates to wind the webs reliably even if the web is wide, as described above. Furthermore, the apparatus can make the winding products and the winding shaft separated from each other without difficulty.

The invention claimed is:

1. An apparatus for winding slit webs about a winding shaft after slitting the web in a slitter, the winding shaft being disposed between and supported by a pair of side plates, the apparatus being characterized in that the winding shaft comprises two divided shafts positioned substantially end to end which are supported by intermediate support member means positioned between the divided shafts, drive motor means being connected to the divided shafts, each of the divided shafts including an end provided with a bearing box and disposed at the position of intermediate support member means, the bearing box being supported by the intermediate support member means, the divided shafts being rotated by the drive motor means when being supported by the intermediate support member means, to wind the webs about each of the divided shafts and obtain a plurality of winding products on each of the divided shafts, the winding products being spaced from each other along each of the divided shafts, carts being disposed under the winding products, the carts including lifters by which tables are lifted so that the winding products can be supported on the tables after the winding products are moved widthwise thereof along each of the divided shafts and toward the intermediate support member means after winding, the tables having sizes corresponding to a total of widths of the winding products moved widthwise thereof toward the intermediate support member means, each of the side plates being then moved axially of the winding shaft, the divided shafts being drawn by the side plates, moved axially thereof and apart from each other to be extracted from the winding products.

2. The apparatus as set forth in claim 1 wherein the drive motor means comprises drive motors, each of the side plates being provided with the drive motor connected to the divided shaft, the divided shaft being rotated by the drive motor to wind the webs, the divided shaft being drawn by the side plate so that the bearing box can be drawn from the intermediate support member means, the divided shaft being then extracted from the winding products.

* * * * *